US005808230A

United States Patent [19]

Zanieri

[11] Patent Number: 5,808,230

[45] Date of Patent: Sep. 15, 1998

[54] BREECHLOCK FOR AUTOMATIC OR SEMI-AUTOMATIC WEAPONS

[76] Inventor: Gianni Zanieri, Via Fratelli Rosseli, 9-50018 Scandicci (Prov. of Florence), Italy

[21] Appl. No.: 815,651

[22] Filed: Mar. 13, 1997

[30] Foreign Application Priority Data

Mar. 13, 1996 [IT] Italy ..... FI96A0045

[51] Int. Cl.[6] ..... F41A 3/44

[52] U.S. Cl. ..... 89/181; 89/187.01

[58] Field of Search ..... 89/187.01, 180, 89/181, 44.02

[56] References Cited

U.S. PATENT DOCUMENTS 1,041,046 10/1912 Dorn ..... 89/187.01

3,199,407 8/1965 Henisa ..... 89/187.01

3,793,922 2/1974 Angell et al. ..... 89/180

*Primary Examiner*—Stephen M. Johnson

*Attorney, Agent, or Firm*—Abelman, Frayne & Schwab

[57] ABSTRACT

Breechblock for automatic or semiautomatic weapons provided with fixed barrel and burstbox integral with the barrel, wherein the breechblock is provided with adjustable elastic means capable of opposing to the initial displacement of the breechblock in respect of the burstbox at the moment of the shooting, such means allowing the subsequent moving back of the breechblok in order to allow the ejection of the cartridge case, the cocking of the striker and the loading of a new cartridge.

8 Claims, 2 Drawing Sheets

BREECHLOCK FOR AUTOMATIC OR SEMI-AUTOMATIC WEAPONS

FIELD OF THE INVENTION

The present invention refers to automatic or semiautomatic weapons, in particular handguns, and to the devices used to realize the closing of the burst box at the moment of shooting.

STATE OF THE ART

As it is known in the automatic or semiautomatic weapons the device closing the burstbox plays a vital role and represents one of the main characteristic of the weapon. The importance of the device is due to the fact that the quality of the shooting (accuracy of fire, handiness, burst) largely results from the technical solutions adopted for its manufacturing. The closing device normally comprises a breechblock slide which allows the closing of the burst box at the moment of the shooting and utilizes the energy developed by the bursting of the cartridge to permit the ejection of the cartridge case and the subsequent loading of a new cartridge. Therefore the breechblock must oppose the initial force developed by the bursting of the cartridge (closing the burstbox with a strength sufficient to allow the shooting of the bullet without loss of energy) but without restraining the closing mechanism, i.e. leaving the slide free of moving back after the bursting in order to allow the ejection of the cartridge case and the automatic loading.

Referring now in particular to automatic or semiautomatic handguns, several solutions are possible to restrain the breechblock in order to obtain the wanted effect i.e. delaying the opening of the burstbox immediately after shooting and the consequent development, in the burstbox, of the highest pressure on the bullet; such solutions are represented mainly by:

1) a fixed barrel with inertial mass closing;

2) a fixed barrel with inertial mass and damping pistons;

3) a mobile barrel with geometric closing or short recoil.

However, all the above said solutions present some drawbacks. In particular the first solution, which is mechanically very simple, does not allow the use of a powerful cartridge since in this case in order to allow a good closing it should be necessary to use such a heavy slide that it would be practically impossible to use the weapon. The other above reported solutions were adopted in order to overcome the above drawback but the second involves structural complications of manufacturing with high costs and problems of maintenance while the third (mobile barrel) does not allow sufficient accuracy of fire.

OBJECT OF THE INVENTION

A first object of the present invention is to overcome the above drawbacks by a breechblock for automatic or semiautomatic weapons, including handguns with a fixed barrel, the breechblock being very simple and economical and allowing the use of powerful cartridges. A further object of the present invention is to allow the use, with the same weapon, of cartridges of different power, giving the user the possibility of regulating the reaction force of the breechblock in consequence of the pressure following the bursting of the chosen cartridge. A further object is to avoid the collision of the breechblock against the bottom of the weapon shell after shooting. A still further object of the invention is to avoid the use of mobile heavy masses making easier the use of the weapon.

SUMMARY OF THE INVENTION

The above said objects are reached according to the invention by a breechblock for automatic or semiautomatic weapons, particularly handguns but also rifles, submachine guns and similar weapons, wherein the initial push of the bursting on the breechblock is opposed by the reaction of adjustable elastic means capable of opposing the initial displacement of the breechblock in respect of the burstbox.

After the initial phase, such means allow the back sliding of the breechblock in order to perform the following phases of ejection of the cartridge case, the cocking of the striker and the loading of a new cartridge. The device comprises also a return spring to pull the breechblock back to its starting position after it has been pushed back by the bursting. According to a preferred form of the invention, foreseen for application to an automatic handgun provided with fixed barrel and burstbox integral with the barrel, the device comprises a breechblock coaxial to the barrel and comprising a diskshaped bottom capable of closing the burstbox.

The breechblock presents on the front of the bottom a plurality of arms disposed longitudinally around the barrel and having one extremity integral with the bottom while the other extremity reaches the mouth of the barrel and engages with it by locking teeth. Upon the bursting of the cartridge, the bottom pulls back the breechblock (under the action of the bursting pressure) so that the locking teeth are lifted on the top of the barrel mouth and the arms elastically diverge opposing, in this initial phase, the sliding between breechblock and burstbox. The elastic reaction is adjusted by moving axially a ring disposed outwardly around the arms; by moving the ring along the arms it is possible to vary the length of the arm free of bowing i.e. the part comprised between the ring and the free extremities. The return spring is placed in the space between the barrel and the arms and works between a fixed seat put in front of the burstbox and the front extremity of the arms.

The first advantage is represented by the fact that the whole weight of the weapon is decreased since the usual breechblock slide is eliminated. Moreover the described solution is very simple and economical, permits the use of different cartridges, more or less powerful, without demanding complicated manufacturing operations.

A still further advantage is that by adjusting the elastic reaction it is possible to avoid the collision of the breechblock against the bottom of the weapon after shooting.

DESCRIPTION OF THE DRAWINGS

The advantages can be better understood in the light of the appended drawings; in particular.

DETAILED DESCRIPTION OF THE INVENTION

Figure 1:
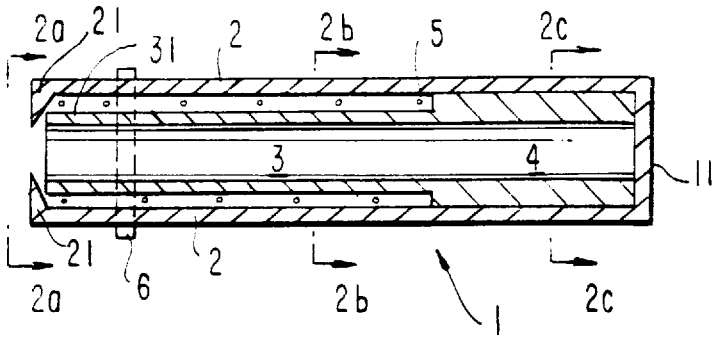
FIG. 1 shows a view of a longitudinal section of a device according to the invention.

Referring to the drawings a device for automatic or semiautomatic weapons according to the invention comprises of a breechblock 1, parallel to a barrel 3 and comprising a bottom 11 to which are attached four arms 2 fixed along the outward edge of the bottom at the same distance between each other and disposed longitudinally along the barrel of the weapon. The bottom 11 closes a burstbox 4, open at the back, to which is joined the barrel 3, coaxial with the burstbox 4, having a diameter equal or slightly inferior to that of the burstbox.

FIG. 1 shows the breechblock before the bursting of the cartridge: the bottom closes the burstbox 4 and the arms 2 are placed between the back of the burstbox 4 up to the mouth 31 of barrel 3 where they show an indented locking tooth 21. The teeth 21 are placed in such a way that they present a sliding incline in respect of the front of the mouth 31 but are on the outward of the barrel hole. As can be seen from the figure, in the space comprised between the outward surface of the barrel and the inner surface of the arms is placed a coil spring 5, working on the burstbox and the locking teeth 21 of the arms. Around the arms there is a ring 6 which can be moved from the front extremity of the arms to a distance which can be adjusted and fixed, for example, by a thread coupling or similar means.

Figure 3:
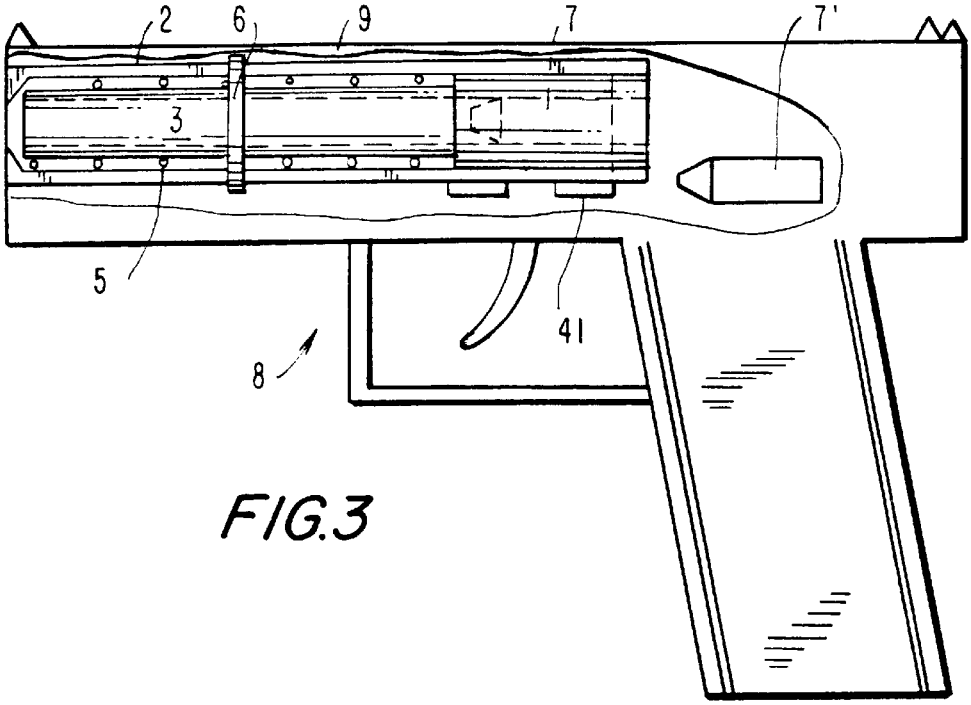
FIG. 3 shows a lateral section of an automatic gun having fixed barrel with a device according to the invention.

FIG. 3 shows an automatic handgun, comprising a barrel 3 and a burstbox 4, integral to the barrel and fixed to the gun front by hooks 41. Inside the burstbox 4 there is a cartridge ready for use (the firing pin is not shown in the figure and is preferably placed in the room below the burstbox and can be driven against the breechblock by a rocking arm.) Upon shooting the bottom of the cartridge case 7 pushes back the bottom 11 and the arms 2, integral to the bottom, slide back pulling the teeth 21 over the mouth 31. As a consequence the arms elastically deform and open wide. According to the invention the initial elastic reaction of arms 2 is such that the burstbox 4 remains closed for a delay time sufficient to allow the shooting of the bullet; immediately thereafter when the teeth 21 are already resting on the outward surface of the barrel 3, the breechblock can slide back for the usual performing of the phases of cartridge ejection, cocking of the striker and loading of a new cartridge. In the end the breechblock 1 is driven back to its starting position by the spring 5.

According to a particular feature of the invention, the free length of the arms 2 is adjusted by moving the ring 6 in such a way that the force necessary to open the arms wide, and therefore to open the burstbox, decreases by moving the ring far from the mouth 31. This feature allows the use for the same gun of cartridges having different power and for which different compensating forces are therefore necessary.

FIG. 3 shows also the outward shell 9 which covers the device described in the present invention for the sake of completeness of representation of the gun 8. In the present description only the parts necessary for the understanding of the invention were shown. Anyhow it is pointed out that the described device can be used for all the common automatic or semiautomatic weapons, although not described in detail, by operating the appropriated modifications of dimensions and/or materials. It is also evident that it is possible to realize the invention in other forms, for example by making the teeth act, instead of on the barrel mouth on different fixed parts of the weapon (for example the burstbox walls).

Figure 1A:
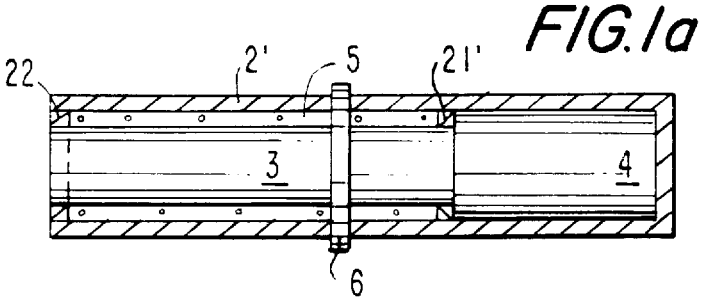
FIG. 1*a* shows a second realization of the device.
Figure 2A:
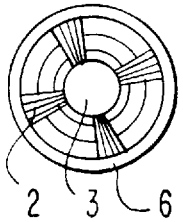
FIG. 2*a*, 2*b*, 2*c* show views of the device of FIG. 1 according to lines AA; BB; and CC.
Figure 2B:
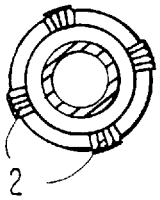
Figure 2C:
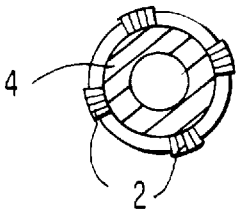

For example in FIG. 1*a* is shown a second form of realization of the invention wherein the front ends of the arms 2' are made integral with a ring which acts also as ledge for the compression of the spring 5. In this case the deformation of the arms is due to the presence of the intermediate teeth 21', acting on the front wall of the burstbox 4 and capable of sliding on the burstbox after the initial deformation of the arms. According to this solution the elastic reaction is controlled by the length ring 6/teeth 21'. It is anyhow evident that in both of the described forms of realization of the invention, the free space between the arms must be such as to allow the loading and the ejection of the cartridge cases.

Figure 4A:
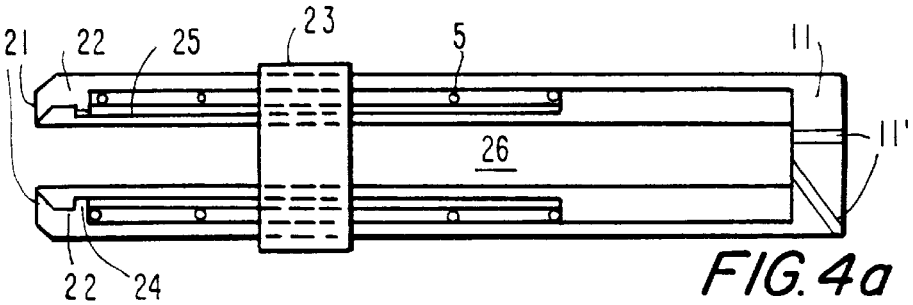
FIG. 4*a*, 4*b*, 4*c* show a preferred embodiment of the invention respectively in a plan, a bottom and a frontal view.
Figure 4B:
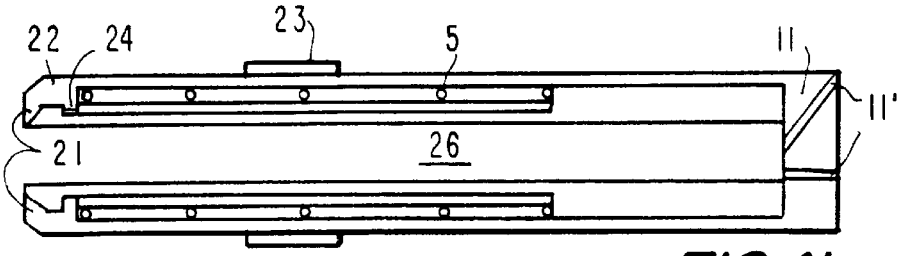
Figure 4C:
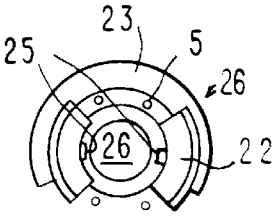

FIGS. 4*a*, 4*b*, 4*c* describe a third preferred embodiment of the invention in which only two lateral arms 22 are attached to the bottom 11. The illustrated holes 11' of the bottom 11 are intended to allow the arming and the action of a firing pin which is not described in that it is not part of the invention. In this example, the deformation of the arms 22 is adjusted by moving along the arms an upper half-ring 23 which position can be fixed by a thread coupling of the half-ring with the external surface of the arms, or by similar means. In addition to the already described teeth 21, the front end of the arms 22 presents a second tooth 24 which during the breechblock displacement slides inside an external groove 25 of the barrel 26. The teeth 24 act both as retaining means of the spring 5 and as guiding means of the arms 22 on the barrel. The mouth of the barrel presents a section having the same inclination as the teeth 21 (having for example an inclination of approximately 40–50°) in order to make easier their deformation. In this embodiment, the lower part of the device presents reduced overall dimensions, so that there is more space available to install the mechanisms (trigger, lever means to arm the firing pin etc.) which are not part of the present invention but which can vary depending on the particular weapon and are necessary for the operation of the same.

I claim:

1. Breechblock for automatic or semiautomatic weapons of the kind provided with a fixed barrel and a burstbox integral to the barrel, wherein such breechblock comprises adjustable elastic reaction means capable of opposing the initial displacement of the breechblock in respect of the burstbox at the moment of shooting and allowing the subsequent moving back of the breechblock in order to allow an ejection of a cartridge case, and a loading of a new cartridge, and such breechblock further comprises a return spring capable of pushing the breechblock back to a s tar ting position before shooting, said return spring being located in a tubular space between said barrel and said adjustable elastic reaction means.

2. Breechblock for automatic or semiautomatic weapons of the kind provided with a fixed barrel and a burstbox integral to the barrel, wherein such breechblock comprises adjustable elastic reaction means capable of opposing the initial displacement of the breechblock in respect of the burstbox at the moment of shooting and allowing the subsequent moving back of the breehblock in order to allow an ejection of a cartridge case, and a loading of a new cartridge, said breechblock further comprising a diskshaped bottom closing the burstbox, said adjustable elastic means comprising a plurality of arms integral to the closing bottom from which said arms extend, coaxially and outwardly placed around the burstbox and the barrel, up to a mouth of the barrel, an external surface of which barrel said arms touch and elastically engage by sloping inwardly protruding teeth of frontal free ends of the arms.

3. Breechblock according to claim 2, characterized in that said adjustable elastic means comprehend a ring sliding on the external surfaces of the arms in order to fix a predetermined free bending length in respect to the front end of the arms.

4. Breechblock according to claim 2, characterized in that said arms are four.

5. Breechblock according to claim 2, characterized in that said arms are equally spaced between each other.

6. Breechblock for automatic or semiautomatic weapons of the kind provided with a fixed barrel and a burstbox integral to the barrel, wherein such breechblock comprises adjustable elastic reaction means capable of opposing the initial displacement of the breechblock in respect of the burstbox at the moment of shooting and allowing the subsequent moving back of the breechblock in order to allow an ejection of a cartridge case, and a loading of a new cartridge, wherein said breechblock presents an elongated shape coaxial to the barrel and to the burstbox, and said breechblock further comprises a bottom closing the burstbox, said reaction means comprising two lateral arms integral to the bottom and extended from the bottom to a mouth of the barrel, a section of the mouth presenting the same inclination as corresponding teeth of the arms.

7. Breechblock according to claim 6, wherein said reaction means comprise an upper half ring threadedly coupled with an external surface of the arms in order to define a prefixed free bending length of the arms.

8. Breechblock according to claim 6 characterized in that said arms present a second tooth which during the breechblock displacement slides inside an external groove of the barrel, said second tooth acting both as retaining means of a spring and as guiding means of the arms on the barrel.

* * * * *

UNITED STATES PATENT AND TRADEMARK OFFICE

CERTIFICATE OF CORRECTION

PATENT NO. : 5,808,230
DATED : September 15, 1998
INVENTOR(S) : ZANIERI

It is certified that error appears in the above-identified patent and that said Letters Patent is hereby corrected as shown below:

On the Cover Page of the Patent, in Column 1, after "[54]", delete the first word of the Title of the Invention, "BREECHLOCK", and substitute therefor --BREECHBLOCK--.

At Column 1, line 1 of the Patent, delete "BREECHLOCK", and substitute therefor --BREECHBLOCK--.

At Column 2, line 57 of the Patent, delete "AA; BB; and CC;" and substitute therefor -- 2a-2a; 2b-2b; and 2c-2c; --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*